United States Patent [19]

Konno

[11] Patent Number: 4,799,463

[45] Date of Patent: Jan. 24, 1989

[54] VALVE OPERATING MECHANISM FOR INTERNAL COMBUSTION ENGINES

[75] Inventor: Tsuneo Konno, Saitama, Japan

[73] Assignee: Honda Giken Kogyo Kabushiki Kaisha, Tokyo, Japan

[21] Appl. No.: 122,080

[22] Filed: Nov. 18, 1987

[30] Foreign Application Priority Data

Nov. 18, 1986 [JP] Japan ..... 61-176880[U]

[51] Int. Cl.[4] ..... F01L 1/34; F01L 1/04

[52] U.S. Cl. ..... 123/90.17; 123/90.16; 123/90.44

[58] Field of Search ..... 123/90.16, 90.17, 90.44, 123/90.6

[56] References Cited

U.S. PATENT DOCUMENTS 4,523,550 6/1985 Matsuura ..... 123/90.17 X
4,612,884 9/1986 Ajiki et al. ..... 123/90.16
4,690,110 9/1987 Nishimura et al. ..... 123/90.17
4,727,830 3/1988 Nagahiro et al. ..... 123/90.16
4,727,831 3/1988 Nagahiro et al. ..... 123/90.16

*Primary Examiner*—Willis R. Wolfe
*Attorney, Agent, or Firm*—Lyon & Lyon

[57] ABSTRACT

A valve operating mechanism for an internal combustion engine having cams rotatable in synchronism with a crankshaft, a pair of valves disposed in intake or exhaust ports of a combustion chamber, and four pivotable rocker arms for transmitting the lifting motion of said cams to said valves. Four cams are provided with different cam profiles corresponding to respective ranges of rotational speeds of the engine. Switching means are operated by hydraulic oil pressure for selectively connecting and disconnecting the rocker arms to thereby operate the valves in several different modes for different engine speeds.

11 Claims, 4 Drawing Sheets

VALVE OPERATING MECHANISM FOR INTERNAL COMBUSTION ENGINES

The present invention relates to a valve operating mechanism for an internal combustion engine, and more particularly to a valve operating mechanism capable of varying its operation timing according to the rotational speed of the engine.

As is well known, an air-fuel mixture is drawn into and a combustion gas is discharged from a combustion chamber of an internal combustion engine through operation of a valve operating mechanism. Valves operated by the valve operating mechanism are opened and closed at timings dependent on the angle of rotation of the crankshaft, i.e., the stroke of the piston. There is a time lag or delay developed between the valve opening and closing operation and the actual flow of the air-fuel mixture due to the inertia of the mass of the air-fuel mixture itself. In order to cancel out such a time lag, it is necessary to select the operation timing of the valves in anticipation of the inertia of the air-fuel mixture. In general, however, the operation timing of the valves has to be of an average value in view of the normally used speed range of the engine. The setting of the operation timing of the valves is one of the factors for determining the characteristics of the engine.

In view of the above consideration, the applicant has proposed a valve operating mechanism for selectively connecting and disconnecting three rocker arms to selectively vary the operation timing of a pair of valves according to the cam profile of one of either high-speed or low-speed cam (see Japanese Laid-Open Patent Publication No. 61-19911).

While it would be desirable to operate the valves in more than two modes, high-speed and low-speed, for controlling the valve operating mechanism in a greater number of different control modes to achieve smoother switching operation dependent on the rotational speed of the engine, it would be necessary to provide a greater number of cams of different cam profiles.

In view of the aforesaid technical trend, it is a principal object of the present invention to provide a valve operating mechanism for an internal combustion engine, which is capable of controlling valve operation timing in an increased number of modes.

According to the present invention, the above object can be accomplished by providing a valve operating mechanism for an internal combustion engine, having cams rotatable in synchronism with a crankshaft, a pair of valves disposed in intake or exhaust ports of a combustion chamber, and means for transmitting the lifting motion of said cams to said valves, characterized in that said cams include two or more cams having different cam profiles corresponding to respective ranges of rotational speeds of the engine, f and the lifting motion transmitting means comprising four or more mutually adjacent members, there being switching means for selectively connecting and disconnecting the mutually adjacent members of said transmitting means.

With this desired arrangement, the operation timing of the pair of valves can be varied in four or more stages, so that variable control of the operation timing of the valves can be effected in an increased number of modes.

A preferred embodiment of the present invention will hereinafter be described in detail with reference to the accompanying drawings, wherein.

Figure 1:
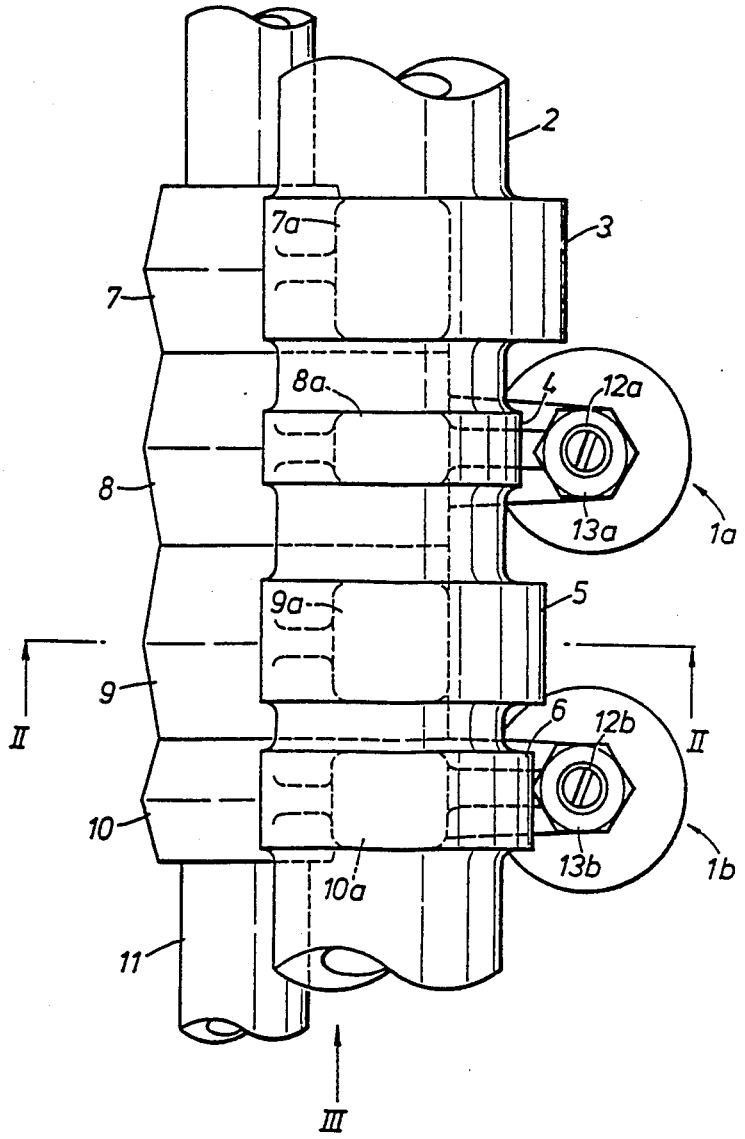
FIG. 1 is a plan view of a portion of the valve operating mechanism of this invention.

As shown in FIG. 1, an internal combustion engine body (not shown) has a pair of intake valves 1a, 1b per cylinder. The intake valves 1a, 1b can be opened and closed by first through fourth cams 3–6 of mutually different cam profiles that are integrally formed on a camshaft 2 rotatable in synchronism at a speed ratio of ½ with respect to the speed of a crankshaft (not shown). The lifting motion of the cams is transmitted by first through fourth rocker arms 7–10 pivotally mounted on a rocker shaft 11 and in engagement with these cams 3–6, respectively. The internal combustion engine also has a pair of exhaust valves (not shown) which can be opened and closed in the same manner as the intake valves 1a, 1b.

The first through fourth rocker arms 7–10 are disposed adjacent to each other and are pivotally supported on the rocker shaft 11 which is disposed below and extends parallel to the camshaft 2. The second and fourth rocker arms 8 and 10 are basically of the same configuration and have proximal portions pivotally supported on the rocker shaft 11 and free ends extending over the intake valves 1a and 1b. The free ends of the second and fourth rocker arms 8, 10 supported tappet screws 12a, 12b, respectively, threadedly adjustable therethrough and engaging the upper ends of the valve stems of the intake valves 1a, 1b. The tappet screws 12a, 12b are locked in their adjusted positions by respective locknuts 13a, 13b so that they will not be loosened inadvertently.

Figure 3:
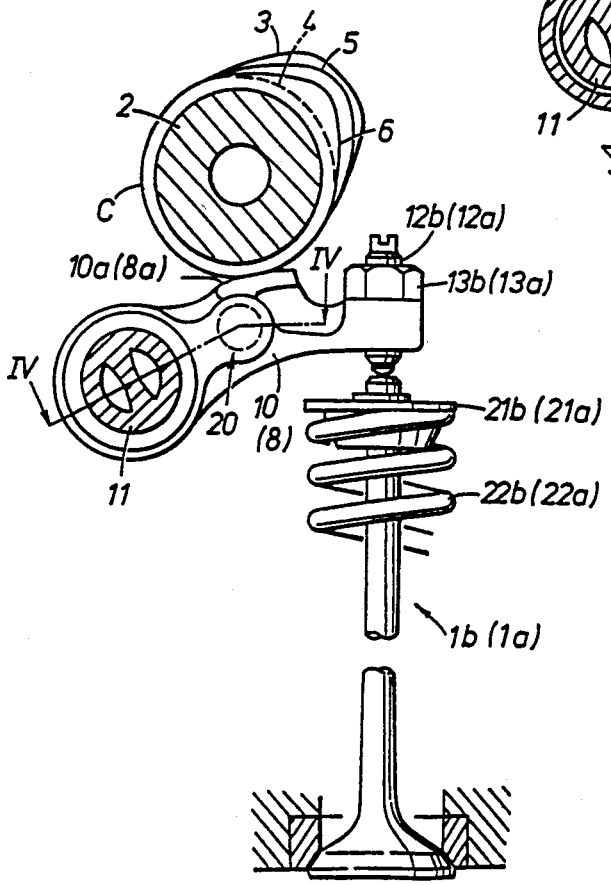
FIG. 3 is a sectional elevation view taken in the direction of arrow III in FIG. 1.

Retainers 21a, 21b are mounted respectively on the upper ends of the valve stems of the intake valves 1a, 1b. Valve springs 22a, 22b are disposed around the valve stems, respectively, between the retainers 21a, 21b and the engine body for normally urging the intake valves 1a, 1b in a closing direction, i.e., upwardly in FIG. 3.

Figure 2:
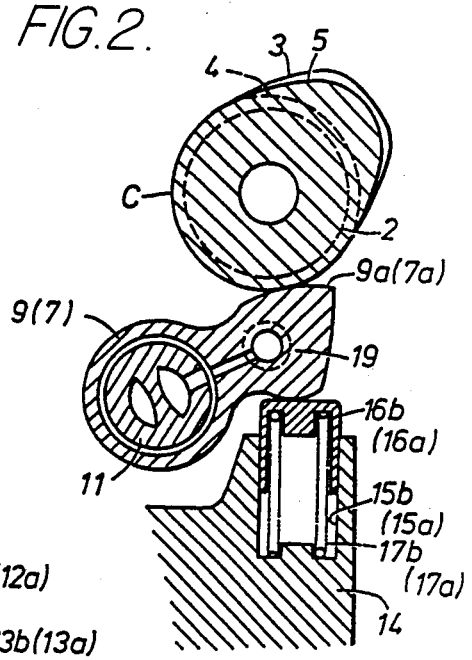
FIG. 2 is a sectional elevation view taken substantially on the line II—II in FIG. 1.

The first rocker arm 7 is pivotally supported on the rocker shaft 11 adjacent to the second rocker arm 8, and the third rocker arm 9 is pivotally supported on the rocker shaft 11 between the second and fourth rocker arms 8, 10. The first and third rocker arms 7, 9 extend from the rocker shaft 11 for a short distance in the same direction as the direction in which the second and fourth rocker arms 8, 10 extend. As better illustrated in FIG. 2, the first and third rocker arms 7, 9 have cam slippers 7a, 9a on their upper surfaces slidably held against the first and third cams 3, 5. The lower surfaces of the distal ends of the first and third rocker arms 7, 9 are in abutment against the upper ends of lifters 16a, 16b slidably fitted in guide holes 15a, 15b defined in a cylinder head 14. Coil springs 17a, 17b are disposed under compression between inner surfaces of the lifters 16a, 16b and the bottoms of the guides holes 15a, 15b for normally urging the lifters 16a, 16b in an upward direction thereby to keep the cam slippers 7a, 9a of the first and third rocker arms 7, 9 in sliding contact with the first and third cams 3, 5 at all times.

As described above, the camshaft 2 is rotatably supported above the engine body, and has the first cam 3 aligned with the first rocker arm 7, the second cam 4 aligned with the second rocker arm 8, the third cam 5 aligned with the third rocker arm 9, and the fourth cam 6 aligned with the fourth rocker arm 10. As better shown in FIG. 3, these cams have the same base circle C. The first cam 3 has a relatively large cam lift over a relatively wide angular range and a cam profile corresponding to high-speed operation of the engine. The outer peripheral surface of the first cam 3 is slidably held in contact with the cam slipper 7*a* on the upper surface of the first rocker arm 7. The second cam 4 has a base circle portion only and is slidably held in contact with a cam slipper 8*a* of the second rocker arm 8. The third cam 5 has a slightly smaller cam lift over a slightly smaller angular extent than those of the first cam 3 and a cam profile corresponding to medium-speed operation of the engine. The third cam 5 has its outer peripheral surface slidably held in contact with the cam slipper 9*a* of the third rocker arm 9. The fourth cam 6 has a smaller cam lift over a smaller angular extent than those of the third cam 5 and a cam profile corresponding tot low-speed operation of the engine. The fourth cam 6 has its outer peripheral surface slidably held in contact with a cam slipper 10*a* of the fourth rocker arm 10. The lifters 16*a*, 16*b* are omitted from illustration in FIG. 3.

The first through fourth rocker arms 7–10 engaging the first through fourth cams 3–6, respectively, are selectively brought into a condition in which adjacent ones of the rocker arms are swingable together and another condition in which they are displaceable relatively to each other, by means of first through third couplings 18–20 (described later) mounted in holes defined centrally through the rocker arms 7–10 and extending parallel to the rocker shaft 11.

Figure 4:
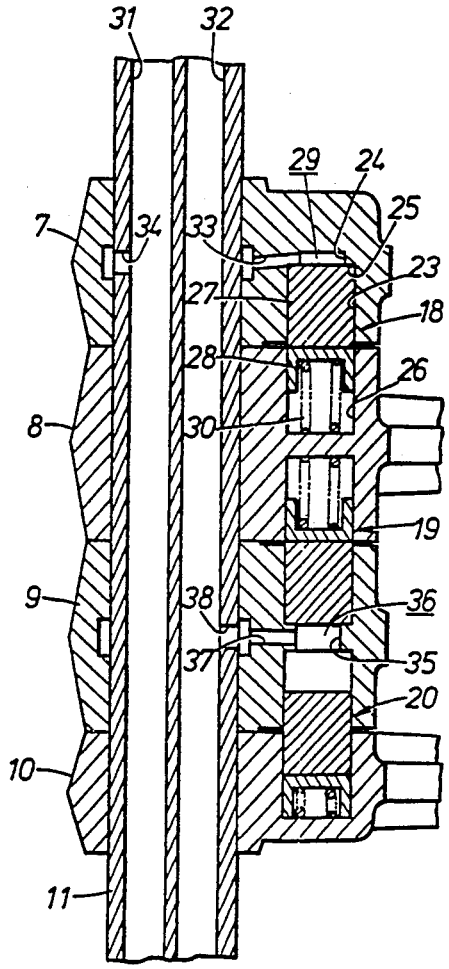
FIG. 4 is a sectional plan view taken substantially on the line IV—IV in FIG. 3.

As better shown in FIG. 4, the first coupling 18 is disposed between the first and second rocker arms 7, 8 the second coupling 19 is disposed between the second and third rocker arms 8, 9, and the third coupling 20 is disposed between the third and fourth rocker arms 9, 10. The first through third couplings 18–20 are of substantially identical constructions and operate in substantially the same manner. Therefore, only the first coupling 18 will be described below.

The first rocker arm 7 has a first guide hole 23 defined therein parallel to the rocker shaft 11 and opening toward the second rocker arm 8. The first rocker arm 7 also has a smaller diameter hole 24 near the bottom wall of the first guide hole 23, with a step 25 being defined between the smaller-diameter hole 24 and the first guide hole 23.

The second rocker arm 8 has a second guide hole 26 defined therein and opening toward the first rocker arm 7, the second guide hole 26 being concentric with and having the same diameter as that of the first guide hole 23 in the first rocker arm 7.

In the first guide hole 23, there is mounted a piston 27 movable across the first and second guide holes 23, 26 between a position in which it interconnects the first and second rocker arms 7, 8 and a position in which it releases them from each other. A stopper 28 for limiting the distance which the piston 27 projects into the second guide hole 26 is mounted in the second guide hole 26.

The piston 27 has a length or axial dimension such that when one end thereof abuts against the step 25 in the first guide hole 23, the other end of the piston 27 does not project into the second guide hole 26 in the second rocker arm 8. A first oil chamber 29 is defined between the end face of the piston 27 and the bottom surface of the smaller-diameter hole 24.

A coil spring 30 is disposed under compression between the inner surface of the stopper 28 and the bottom surface of the second guide hole 26 for normally urging the stopper 28 toward the piston 27.

The rocker shaft 11 has first and second working oil supply passages 31, 32 communicating with a hydraulic pressure supply device (described later). Working oil is supplied from the first working oil supply passage 31 to the first hydraulic chamber 29 through a first oil passage 33 defined in the first rocker arm 7 in communication with the hydraulic chamber 29 and a first hole 34 defined in the peripheral wall of the rocker shaft 11, through a circumferential groove in the rocker arm 7 for insuring hydraulic communication from passage 31 to chamber 29 irrespective of how the first rocker arm 7 is angularly moved. Therefore, the piston 27 is displaced under the pressure of the supplied working oil against the biasing force of the coil spring 30 for thereby coupling the adjacent rocker arms.

The second and third couplings 19, 20 are positioned symmetrically with respect to the center of the third rocker arm 9. A smaller-diameter hole 35 is defined in the third rocker arm 9 between the second and third couplings 19, 20, the smaller-diameter hole 35 defining a second hydraulic chamber 36 shared by the second and third couplings 19, 20. The second hydraulic chamber 36 is held in communication with the second working oil supply passage 32 through a second oil passage 37 and circumferential groove defined in the third rocker arm 9 and a second hole 38 defined in the peripheral wall of the rocker shaft 11 for supplying working oil simultaneously to the second and third couplings 19, 20.

The coil springs, comparable to coil spring 30 of coupling 18, for urging the stoppers 28 in the second and third couplings 19, 20 have spring constants of such different values that the third coupling 20 will operate under a lower oil pressure than the second coupling 19.

Figure 5:
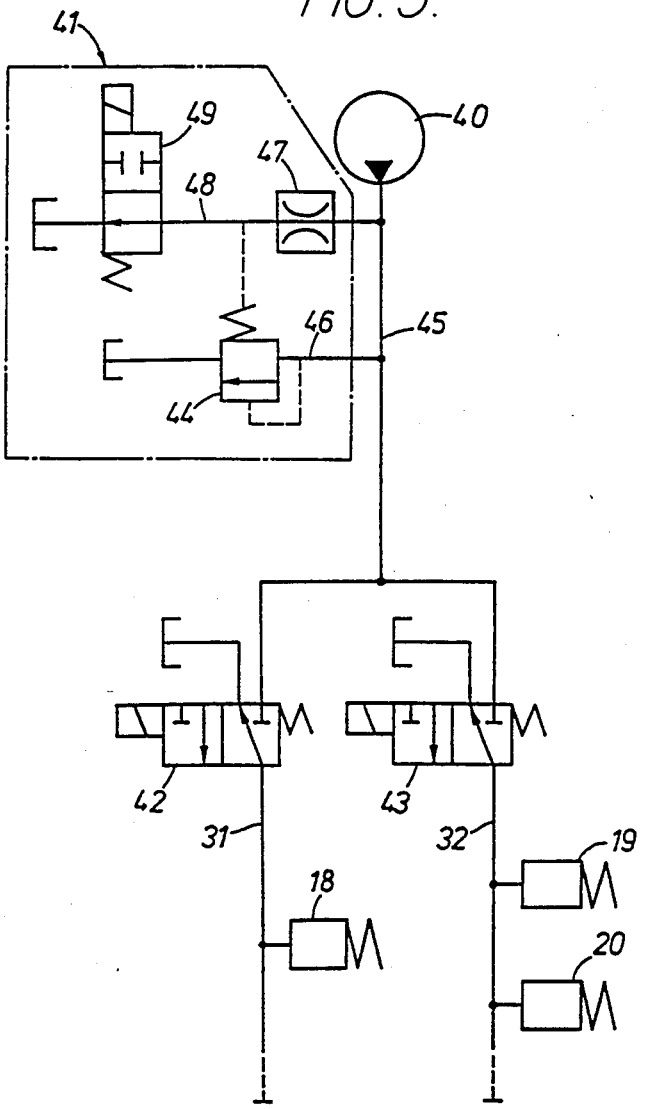
FIG. 5 is a diagram of the hydraulic circuit for the valve operating mechanism of this invention.

FIG. 5 diagrammatically shows a system for supplying oil pressure to the aforesaid embodiment. Oil discharged from a lubricating oil pump 40 coupled to the crankshaft of the engine is regulated to a prescribed pressure by a pressure regular 41, and is thereafter branched into two oil flows. One oil flow goes to the first working oil supply passage 31 through a first 3-port, 2-position solenoid-operated valve 42, whereas the other oil flow goes to the second working oil supply passage 32 through a second 3-port, 2-position solenoid-operated valve 43.

The pressure regular 41 has a relief passage 46 for releasing the oil pressure from a discharge passage 45 into an oil tank through a relief valve 44, and a back-pressure passage 48 adding the oil pressure from the discharge passage 45 through an orifice 47 to the spring force of the relief valve 44. The back pressure to be applied to the back-pressure passage 48 can selectively be interrupted by a third solenoid-operated valve 49 so that the relief valve 44 will operate at two selectable pressure settings.

Under normal condition or upon de-energization, the first and second solenoid-operated valves 42, 43 for selectively connecting and disconnecting the first and second working oil supply passages 31, 32 have their input ports closed and output ports communicating with tank ports, as shown in FIG. 5. When the first and second solenoid-operated valves 42, 43 are energized, the input and output ports are brought into mutual communication to pressurize the oil supply passages 31, 32. Therefore, the pressure of working oil can be supplied to the couplings 18–20 only when the first and second solenoid-operated valves 42, 43 are energized.

Operation of the device as described above will be described below.

When the first and second solenoid-operated valves 42, 43 are de-energized, no oil pressure is supplied to the first and second working oil supply passages 31, 32, and hence the first through third couplings 18–20 are in their disconnecting position under the forces of the coil springs 30 acting on the stoppers 28. Consequently, all of the rocker arms are swingable independently of each other.

In this condition, the first and third cams 3, 5 cause the first and third rocker arms 7, 9 to swing according to their cam profiles, but do not affect operation of the intake valves **1*a*, 1*b*. Since the second cam 24 comprises the base circle portion only, the second rocker arm 8 does not swing, and hence the intake valve 1*a* does not operate. Only the other intake valve 1*b* engaging the fourth rocker arm 10 is caused to be opened and closed according to the cam profile of the fourth cam 6**. This setting is selected for low-speed operation of the engine.

For the next higher speed of operation of the engine, the third solenoid-operated valve 49 is opened to release the back pressure from the relief valve 44 for thereby bringing the circuit pressure to a lower pressure setting. The second solenoid-operated valve 43 is then energized and the working oil pressure is applied via the second working oil supply passage 32 to the second and third couplings 19, 20. Inasmuch as the operating pressure required to operate the second coupling 19 is higher than that required for the third coupling 20, only the third coupling 20 is displaced toward the connecting position as illustrated in FIG. 4, thereby connecting the third and fourth rocker arms 9, 120 to each other. Therefore, the fourth rocker arm 10 is angularly moved in response to the cam profile of the third cam 5 which has a higher lift than that of the fourth cam 4, so that the intake valve **1*b* is opened and closed according to the cam profile of the third cam 5**.

For the highest speed of operation of the engine the third solenoid-operated valve 49 is closed and the back pressure is imposed n the relief valve 44 to bring the circuit pressure to a higher pressure setting. The first and second solenoid-operated valves 42, 43 are energized to shift the first through third couplings 18–20 to their connecting position, whereupon the first through fourth rocker arms 7–10 are interconnected. In this condition, since the lift of the first cam 3 is greatest, the intake valves **1*a*, 1*b* are opened and closed according to the high-speed cam profile of the first cam 3**.

For intermediate engine speeds, the third solenoid-operated valve 49 can be either opened or closed and one or both of the first and second solenoid valves 42, 43 may be opened.

Table 1, below, shows the operative relationship between the couplings 18–20 and the intake valves **1*a*, 1*b***.

TABLE 1

| Coupling in Operation | Cam Operated and its lift | Valve in Operation |
|---|---|---|
| None | 4th low | 1a |
| 3rd | 3rd medium | 1a |
| 2nd, 3rd | 3rd medium | 1a, 1b |
| 1st, 2nd, 3rd | 1st high | 1a, 1b |
| 2nd | 4th low | 1a |

TABLE 1-continued

| Coupling in Operation | Cam Operated and its lift | Valve in Operation |
|---|---|---|
| | 3rd medium | 1b |
| 1st | 4th low | 1a |
| | 1st high | 1b |
| 1st, 3rd | 3rd medium | 1a |
| | 1st high | 1b |

With the above arrangement, it is possible to select one of the seven conditions or states as shown in Table 1 above, so that the intake or exhaust valves can be controlled in an increased number of stages or modes dependent on the rotational speed of the engine.

While in the above embodiment two selectable oil pressure settings are available and two working oil supply passages are provided, the arrangement can be modified to provide more oil pressure settings that can be selected and more working oil supply passages for appropriate selection of coupling pistons to be operated. The present invention is not limited to the above embodiment, but may be modified in various ways by combining various cam profiles.

According to the present invention, as described above, the engine can be operated at a wide variety of valve timings in various modes achieved by combining cams and rocker arms in different positional relationships. The arrangement of the invention is effective in accomplishing smooth valve switching operation to achieve more consistent operating characteristics of the engine.

What is claimed:

1. A valve operating mechanism for an internal combustion engine having cams rotatable in synchronism with a crankshaft, a pair of valves disposed in intake or exhaust ports of a combustion chamber, and means for transmitting lifting motion of said cams to said valves, characterized in that said cams include two or more cams having different cam profiles corresponding to respective ranges of rotational speeds of the engine, said lifting motion transmitting means comprising four or more mutually adjacent members, and switching means for selectively connecting and disconnecting the mutually adjacent members.

2. The valve operating mechanism of claim 1 wherein four cams of different profiles are provided, and said lifting motion transmitting means includes a separate cam follower for engaging each cam.

3. The valve operating mechanism of claim 2, wherein one of said cams has only a base circle and the cam follower engaging that said one cam also engages one of the valves of said pair of valves for retaining that said one valve closed when that engaging cam follower is disconnected from said mutually adjacent members.

4. The valve operating mechanism of claim 2, wherein said four cams comprise cam shapes for high-speed operation, medium-speed operation, low-speed operation, and for retaining one valve closed for even lower speed operation.

5. The valve operating mechanism of claim 2, wherein two of said cam followers separately engage the pair of valves.

6. The valve operating mechanism of claim 5, wherein another of said cam followers is positioned between said two cam followers engaging the pair of valves.

7. The valve operating mechanism of claim 6, wherein switching means are provided in said another cam follower for selectively connecting said another cam follower to one or both of said two cam followers which it is between.

8. The valve operating mechanism of claim 1, wherein said switching means are hydraulically operated and two separate oil supply passages are provided for selectively operating the switching means.

9. The valve operating mechanism of claim 8, wherein means are provided for selectively operating one or two switching means by one oil supply passage by selectively imposing high or low oil pressure through that oil supply passage.

10. A valve operating mechanism for an internal combustion engine having a cam shaft for operating first and second intake or exhaust valves for each cylinder, comprising, first through fourth pivotally mounted rocker arms, first through fourth cams on said cam shaft having four different cam profiles engaging said first through fourth rocker arms, respectively, the second rocker arm engaging the first valve and the fourth rocker arm engaging the second valve, and switching means provided in said rocker and switching means provided in said rocker arms for selectively connecting said first and second rocker arms, said second and third rocker arms, and said third and fourth rocker arms for operating said first and second valves in various different manners depending on engine operating conditions.

11. The valve operating mechanism of claim 10, wherein said first cam has a high-speed cam profile, said second cam has a base circle cam profile, said third cam has a medium-speed profile, and said fourth cam has a low speed profile.

* * * * *